US006969064B2

(12) United States Patent
Ichikawa et al.

(10) Patent No.: US 6,969,064 B2
(45) Date of Patent: Nov. 29, 2005

(54) PAPER SHEET STORING AND RELEASING APPARATUS

(75) Inventors: Hiroshi Ichikawa, Owariasahi (JP); Hisahiro Koshizuka, Chiyoda (JP); Riichi Kato, Nagoya (JP); Yasunari Niioka, Seto (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 10/856,375

(22) Filed: May 27, 2004

(65) Prior Publication Data

US 2005/0017428 A1 Jan. 27, 2005

(30) Foreign Application Priority Data

Jun. 3, 2003 (JP) ..... 2003-157523

(51) Int. Cl.[7] ..... B65H 29/66
(52) U.S. Cl. ..... 271/216; 242/528
(58) Field of Search ..... 271/216; 242/528; 198/347.3; 221/217; 380/24; 705/43; 902/8

(56) References Cited

U.S. PATENT DOCUMENTS 3,223,344 A * 12/1965 Weymouth ..... 242/564.1
5,735,516 A * 4/1998 Gerlier et al. ..... 270/60
6,700,743 B2 * 3/2004 Fahimi et al. ..... 360/137
2002/0096816 A1 * 7/2002 Sasaki et al. ..... 271/3.14
2004/0124240 A1 * 7/2004 Utz et al. ..... 235/379

FOREIGN PATENT DOCUMENTS

| | | |
|---|---|---|
| JP | 10-181972 | 7/1998 |
| JP | 2000-348235 | 12/2000 |
| JP | 2001-344637 | 12/2001 |
| JP | 2002-187662 A | 7/2002 |

* cited by examiner

*Primary Examiner*—Donald P. Walsh
*Assistant Examiner*—Kenneth W. Bower
(74) *Attorney, Agent, or Firm*—Townsend and Townsend and Crew LLP

(57) ABSTRACT

The present invention provides a paper sheet storing and releasing apparatus which stores and releases paper sheets by winding and unwinding a tape between a wheel and a reel, wherein the apparatus can remove dust stacked on the tape during an operation thereof and reduces damage on the tape. In the paper sheet storing and releasing apparatus which includes a reel which winds and unwinds a tape and a wheel which winds and unwinds the tape and paper sheets and in which running of the tape is stopped at a stop position which constitutes a reference, at the time of releasing the tape from the wheel, the releasing of the tape is temporarily stopped before the tape is stopped at the tape stop position which constitutes the reference and, thereafter, a tape winding operation of a given quantity is performed whereby the dust scraped by a scraper are made to fall and are transferred onto a tape side and the tape is released again so as to reduce a quantity of dust stacked at a final stop position of the tape.

14 Claims, 8 Drawing Sheets

PAPER SHEET STORING AND RELEASING APPARATUS

CROSS-REFERENCE TO RELATED APPLICATION

The present application claims priority from Japanese application JP 2003-157523 filed on Jun. 3, 2003, the content of which is hereby incorporated by reference into this application.

BACKGROUND OF THE INVENTION

The present invention relates to a paper sheet storing and releasing apparatus which handles paper sheets such as bills and checks, and more particularly to a paper sheet storing and releasing device adopting a method which stores paper sheets by winding the paper sheets together with a tape around a wheel and feeds the paper sheets by rewinding the tape wound around the wheel.

There has been known a paper sheet storing and releasing apparatus in which paper sheets are stored by connecting both ends of a tape to a wheel and a reel and by winding the tape in a state that the paper sheets are sandwiched between the wheel and the tape and the paper sheets are fed by rewinding the tape to the reel so as to release the tape from the wheel. This type of apparatus has the simple constitution and hence, the apparatus can be miniaturized and manufactured at a low cost whereby the apparatus has been put into practice as a cash automatic dispenser (ATM) and the like.

For example, Japanese Unexamined Patent Publication Hei 10 (1998)-181972 discloses a technique which, to easily and accurately obtain a transport speed at the time of winding or rewinding a tape, calculates the speed of the tape by calculating a diameter of a drum based on the number of rotation of the drum or by calculating the diameter of the drum based on the number of sheets of bills which are stored on a periphery of the drum.

This type of paper sheet storing and releasing apparatus is housed in a housing of an automatic teller machine (hereinafter referred to as ATM) and the like. There exists a possibility that dust infiltrates into the ATM through a ventilation port or slits of the housing which are formed for lowering the temperature elevation in the inside of the housing. Further, there exists a possibility that dust adheres to bills which a user casts into the ATM and the dust infiltrates into the ATM. When the dust which infiltrates into the ATM adheres to the tape, a member such as a scraper, a roller and the like which comes into contact with the tape collects the dust on the tape and hence, there exists a possibility that the dust which are collected at a position where the tape winding operation or the rewinding operation is finished may be stacked on the tape.

The dust which remains on the tape forms stepped portions on a surface of the tape at the time of winding or rewinding the tape and are brought into contact with the scraper or the roller whereby the tape is liable to be easily damaged locally.

SUMMARY OF THE INVENTION

Accordingly, it is an object of the present invention to provide a paper sheet storing and releasing apparatus which can reduce damage on a tape which is attributed to dust stacked on the tape. It is another object of the present invention to provide a paper sheet storing and releasing apparatus which can remove dust stacked on a tape.

The present invention is directed to a paper sheet storing and releasing apparatus including a reel which winds and unwinds a tape and a wheel which winds and unwinds the tape and paper sheets in a state that the paper sheets are sandwiched between the tape and the wheel, wherein at the time of unwinding the tape from the wheel, before the tape arrives at a stop position which constitutes a reference, the unwinding of the tape is temporarily stopped and the tape is moved in a direction to wind the tape on the wheel and is stopped, and an operation to unwind the tape from the wheel is performed again so as to stop the tape at the stop position which constitutes the reference position.

In a preferred example, after stopping the tape, the reel is driven in a tape unwinding direction and the tape winding direction by a given quantity. Further, in another example, after stopping the tape, the wheel is driven in the tape unwinding direction and the tape winding direction by a given quantity. In still another example, after stopping the tape, the wheel and the reel are driven in the tape unwinding direction and the tape winding direction by a given quantity.

The present invention is also appreciated as a paper sheet storing and releasing apparatus which includes a reel which winds and unwinds a tape, a wheel which winds and unwinds the tape and paper sheets in a state that the paper sheets are sandwiched between the tape and the wheel, and a control mechanism which, during a period that that the paper sheets which are sandwiched between the wheel and the tape are sequentially released by releasing the tape by rotating the wheel and the reel in a reverse direction, generates vibrations on the tape after releasing the paper sheets.

The vibration control mechanism preferably generates the vibrations on the tape by moving the tape to a position where a position of a surface of the tape wound around the reel is directed downwardly and by moving the reel or the wheel at the position in the tape winding direction by a given quantity thus weakening a tension imparted to the tape. This example is disclosed in FIG. 8 to FIG. 12.

The present invention is also appreciated as a tape control method in a paper sheet storing and releasing apparatus which includes a reel which winds and unwinds a tape and a wheel which winds and unwinds the tape and paper sheets in a state that the paper sheets are sandwiched between the tape and the wheel, wherein the tape control method includes a first winding step which winds the tape around the wheel in a state that the fed paper sheets are sandwiched between the tape and the wheel by rotating the wheel and the reel in a normal direction, a tape releasing step which sequentially releases the paper sheets which are sandwiched between the wheel and the tape while releasing the tape by rotating the wheel and the reel in the reverse direction, a stop step which temporarily stops the tape after releasing the paper sheets during the tape releasing step, a second winding step which winds the tape by a given quantity by moving the tape in the normal direction after the stop step, and a winding step which winds the tape around the reel up to a stop position which constitutes a reference after the second winding step.

In a preferred example, the paper sheet storing and releasing apparatus includes an idler roller which guides running of the tape between the reel and the wheel, and performs the stop step and the second winding step to make fall dust stacked on a portion of the tape which has already released the paper sheets and almost reaches the idler roller. Further, the stop step and the second winding step may be performed alternately plural times.

BRIEF DESCRIPTION OF THE DRAWINGS

Preferred embodiments of the present invention will now be described in conjunction with the accompanying drawings, in which.

DESCRIPTION OF THE PREFERRED EMBODIMENTS

Figure 1:
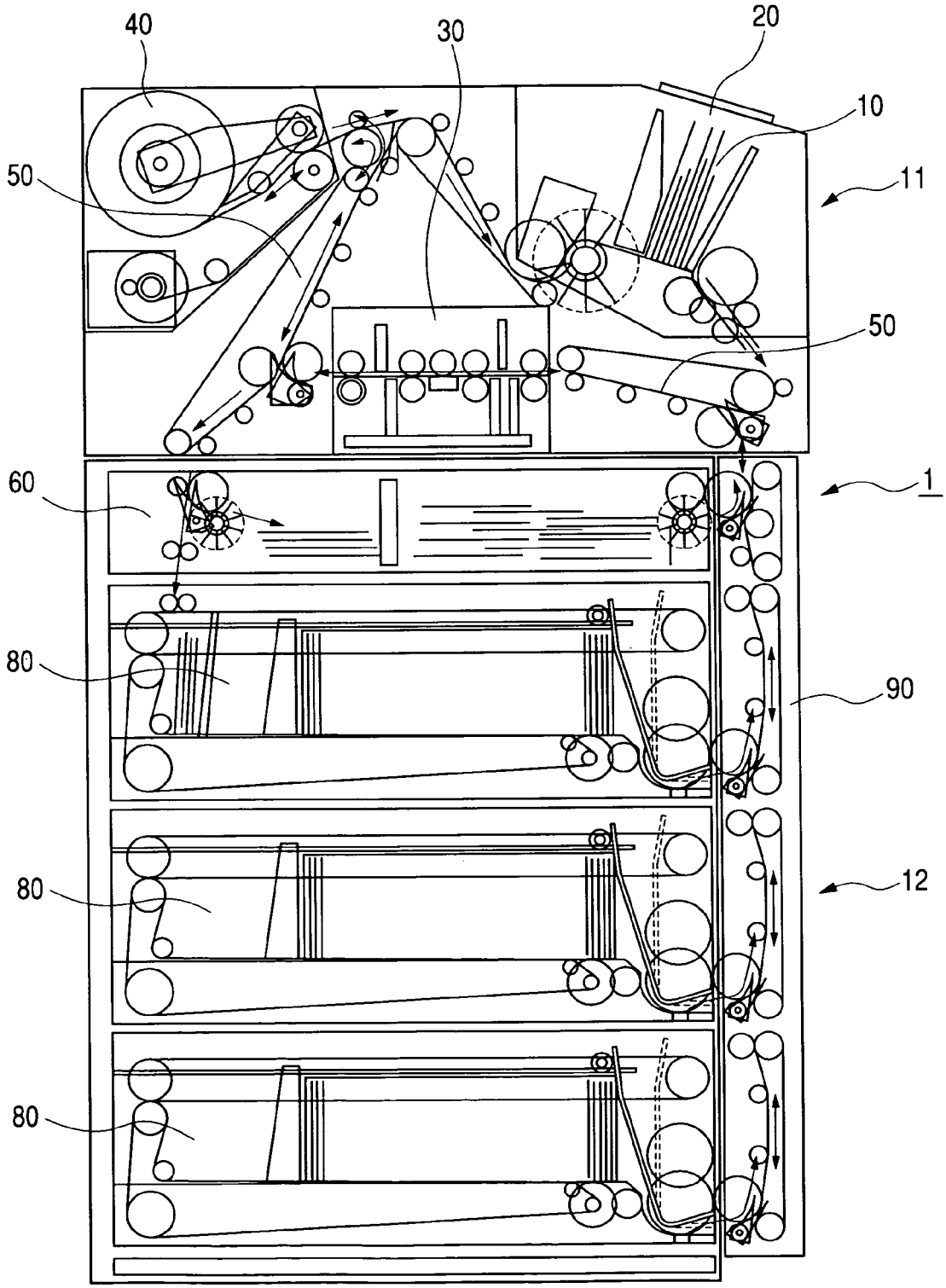
FIG. 1 is a side view showing an example of an ATM to which one embodiment of the present invention is applied.

One embodiment of the present invention is explained in conjunction with drawings hereinafter. FIG. 1 is a side view showing a bill handling apparatus such as an ATM (automatic teller machine) and the like which mounts a paper sheet storing and releasing apparatus according to one embodiment thereon.

The ATM 1 includes a receipt and payment processing mechanism part 11 which is located at an upper side and a safe part 12 which is located at a lower side. The bill receipt and payment mechanism part 11 at the upper side includes a receipt and payment port 20 through which a user inputs bills 10 and takes out bills to be returned, a discrimination part 30 which judges between bills and checks, and a temporary storage box 40 which temporarily stores the received bills until the transaction is established. This temporary storage box 40 constitutes a paper sheet storing and releasing apparatus 40 to which the present invention is directed.

In the lower-side safe part 12, a plurality of bill housing boxes 60, 80 are arranged. The housing box 60 stores the collected bills. The housing box 80 stores the bills for payment in different denominations such as thousand yen bills and ten thousand yen bills. Here, bills which can be reused among the received bills are stored in the housing boxes 80. One of the housing boxes 80 for payment may be used as a bill rolling safe. Each of the housing boxes 60, 80 is provided with a roller mechanism for allowing delivery and feeding of bills at a delivery/feeding port thereof. The respective housing boxes 60, 80 have side portions thereof communicated with a common transfer passage 90 which is formed of a belt mechanism.

Here, the bill receipt and payment processing operation is explained. First of all, the processing operation is explained along with a flow of the bills at the time of receipt transaction. The bills 10 which are cast into the receipt and payment port 20 are separated one by one and are fed to a transport passage 50. The fed bills pass through the transport passage 50 and the judgment of denominations is performed at the discrimination part 30. Thereafter, the bills are transported to a paper sheet storing and releasing apparatus 40 and are temporarily stored in the paper sheet storing and releasing apparatus 40 in a state that the respective denominations are mixed.

A total amount which is calculated based on the result of judgment at the discrimination part 30 with respect to the bills which are collectively cast into the receipt and payment port 20 is displayed on a client manipulation display part (not shown in the drawings) and a client is informed of the total amount. When the client confirms the amount so that the payment transaction is established, the bills stored in the inside of the paper sheet storing and releasing apparatus 40 are released and the bills again pass through the discrimination part 30 due to the transport passage 50 and the judgment of the denominations is again performed. As result of the judgment, the bills are housed in the housing boxes 80 or 60 corresponding to each denomination.

Next, the payment transaction operation is explained. In the ATM 1, the bills corresponding to a designated amount are separated from the inside of housing boxes 80 for respective denominations. The separated bills are transported from the transport passage 90 to the discrimination part 30 through the transport passage 50 and the judgment of the denominations and the normal/damage state are judged. As a result of the judgment, the bills which are judged to be normal bills are transported to the receipt and payment port 20 and are paid to the client. With respect to the bills whose payment is judged inappropriate by the discrimination part 30 due to inferior conditions such as skewed transport bills or fold-back bills, these bills are temporarily stored in the paper sheet storing and releasing apparatus 40. Then, after the establishment of the payment transaction, the bills stored in the paper sheet storing and releasing apparatus 40 are fed out and stored in the housing box 60 from the transport passage 50 through the transport passage 90.

In this manner, the paper sheet storing and releasing apparatus 40 functions as a temporary storage box for temporarily storing the received bills in the housing box 60 or 80, or as a temporary storage for temporarily storing the bills to be paid.

Figure 2:
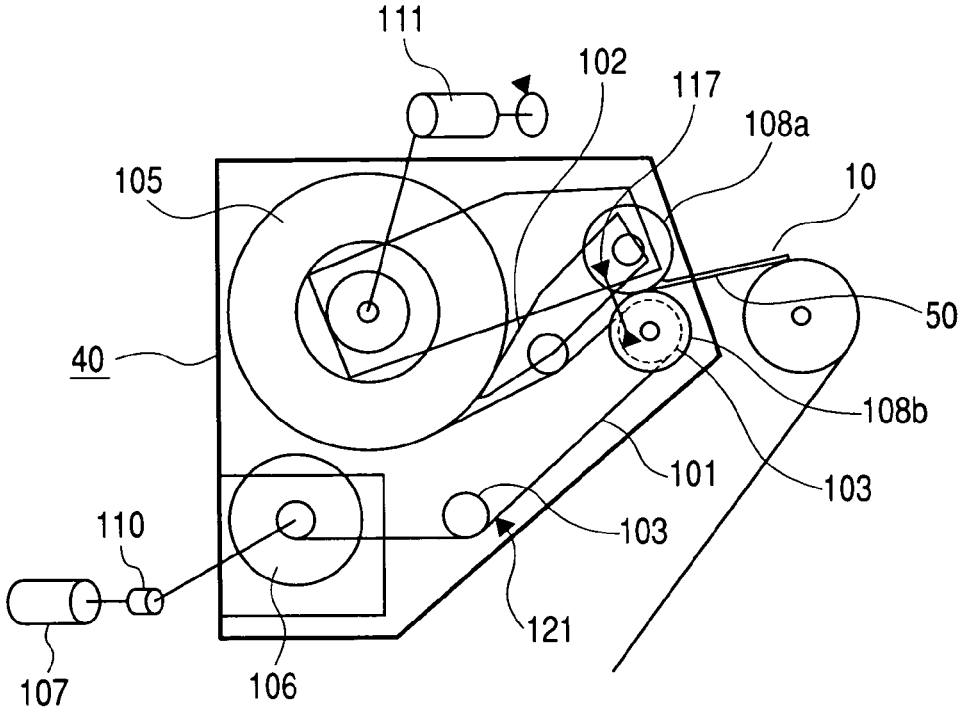
FIG. 2 is a schematic view showing a paper sheet storing and releasing device to which one embodiment of the present invention is applied.

Next, one embodiment of the paper sheet storing and releasing apparatus to which the present invention is applied is explained. FIG. 2 shows the paper sheet storing and releasing apparatus 40. The paper sheet storing and releasing apparatus 40 is constituted as the temporary storage box in the bill handling apparatus 1, wherein the bills are delivered and fed using the short-side direction as the transport direction. Here, one tape 101 is used and, at both ends of the tape, a reel 106 which winds only the tape 101 without including the bills and a wheel 105 which winds the tape 101 in a state that the bills are placed on the tape 101 are provided. The wheel 105 is rotatably driven by a wheel drive motor 111.

Further, a reel drive motor 107 which is rotatably driven by way of a torque limiter 110 for limiting tension is mounted on the reel 106. A stepping motor is used as a wheel drive motor 111 and the wheel drive motor 111 includes a wheel drive motor pulse integration counter which integrates the number of pulses inputted to the wheel drive motor 111 during an operation.

At the time of storing bills, the bills 10 are transported on a tape 101 between and through the transport passage 50 and rollers 108*a*, 108*b*, wherein upon rotation of the wheel 105, the bills are wound around the wheel 105 together with the tape 101. At the time of releasing the bills, the reel 106 winds the tape 110. The bills 10 which are stored are released together with the tape 101. Here, a scraper 102 is brought into contact with the wheel 105 with a given pressure. Since the bills which are released from the wheel are wound around the wheel, there maybe a case where the bills are released along an outer periphery of the wheel. In such a case, the rollers 108*a*, 108*b* at the reception side cannot receive the bills causing a jam. The scraper 102 peels off the bills which are released along the outer periphery of the wheel from the outer periphery of the wheel and guides the bills in the direction of the rollers 108*a*, 108*b*. Thereafter, the bills 10 are separated from the tape 101 due to the rollers 108*a*, 108*b* and are transferred to the transport passage 50. The tape 101 is wound around the reel 106 after passing though the idler rollers 103.

At the time of storing the bills, the tape 101 is wound around the wheel 105. Here, the reel 106 is rotated at a speed lower than a speed of the wheel 105 for pulling out the tape 101. This speed difference can be absorbed due to slipping of the torque limiter 110 and a tension which is set by a torque limiter 110 is imparted to the tape 101. Further, at the time of releasing the bills, the tape 101 is wound around the reel 106. Here, the reel 106 is rotated at the speed higher than a speed of the wheel 105 for feeding the tape 101. This speed difference is also absorbed by slipping of the torque limiter 110 and a tension set by the torque limiter 110 is imparted to the tape 101.

Between the wheel 105 and the reel 106, a tape initial position sensor 121 which detects an initial position of the tape is arranged. The tape initial position sensor 121 detects the initial position of the tape by detecting a portion of the tape which is formed by applying ink having the light blocking property on only a portion of a transparent tape. Between the rollers 108*a*, 108*b* and the wheel 105, a bill passing sensor 117 is arranged. With the provision of the bill passing sensor 117, the transfer of the bills between the paper sheet storing and releasing apparatus 40 and the transport passage 50 is confirmed.

Figure 3:
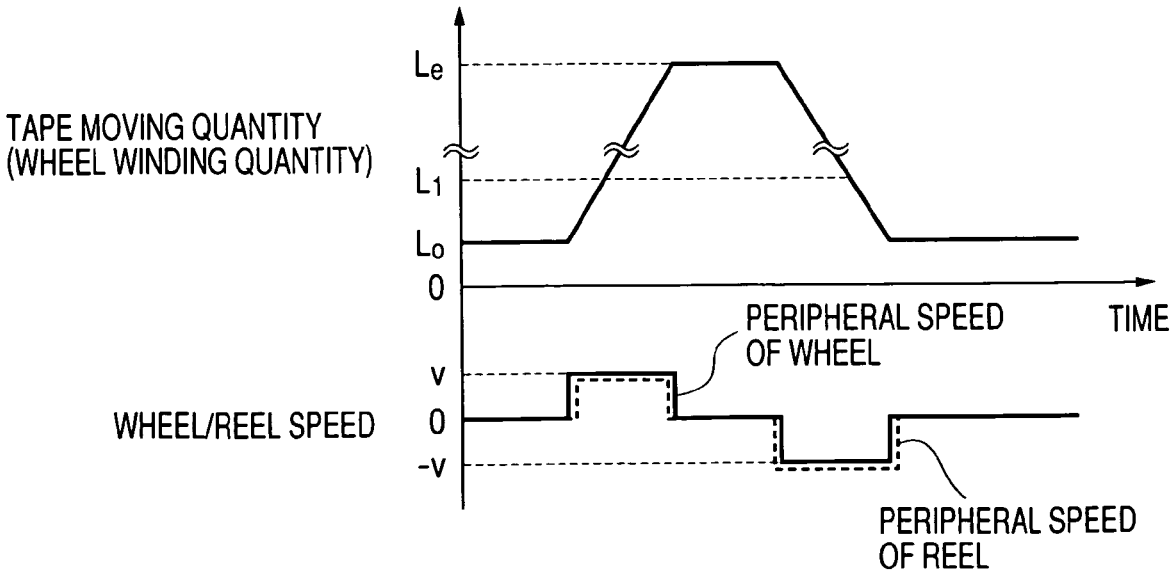
FIG. 3 is a view showing the relationship between speeds of a wheel and a reel and a tape moving quantity.

FIG. 3 is a view which schematically shows a moving quantity of the tape 101 and the speed relationship between the wheel 105 and the reel 106 when the paper sheet storing and releasing apparatus is operated. In FIG. 3, time is taken on an axis of abscissas, the moving quantity of the tape 101 is shown in an upper portion and the speed relationship between the wheel 105 and the reel 106 is shown in a lower portion in the drawing. An axis of ordinates of the tape moving quantity indicates a length of the tape 101 wound around the wheel 105 by assuming a point where the tape 101 is fixed to the wheel 105 as an origin. Symbol Lo indicates a position where the tape initial position sensor 121 detects the initial position of the tape and stops, wherein the tape never fails to stop at this position when the operation is finished. L1 indicates the tape winding length when the first bill is fed into the inside of the paper sheet storing and releasing apparatus at the time of storing, and symbol Le indicates a tape winding length when n bills are stored and the tape stops. The length Le assumes the values which differ depending on the number of bills stored in the paper sheet storing and releasing apparatus.

On the other hand, the axis of ordinates for the speed relationship between the wheel 105 and the reel 106 indicates the rotational direction and the speed. The positive side indicates the direction in which the tape 101 is wound around the wheel 105 and the direction in which tape 101 is unwound from the reel 106, while the negative side indicates the direction in which the tape 101 is unwound from the wheel 105 and the tape 101 is wound around the reel 106.

Since the tape 101 performs the reciprocating movement due to the wheel 105 and the reel 106, particularly at the scraper 102 portions of the positions Lo, Le where tape 101 stops, dust are collected. Since the paper sheet storing and stopping position Le differs depending on the number of accommodating bills, a stacked quantity of the dust is dispersed. Further, even when the dust is stacked by the scraper 102, when the wheel 105 is restarted in the releasing direction, the dust is liable to easily fall due to the gravity.

Figure 4:
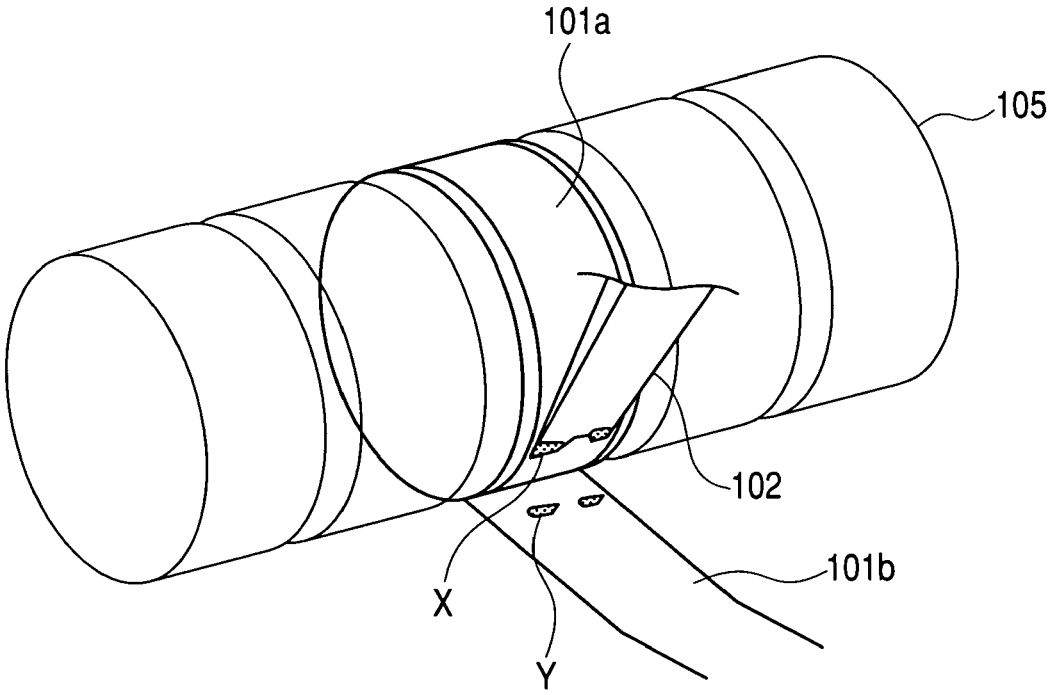
FIG. 4 is a perspective view showing a state that dust is stacked on a wheel portion.
Figure 5:
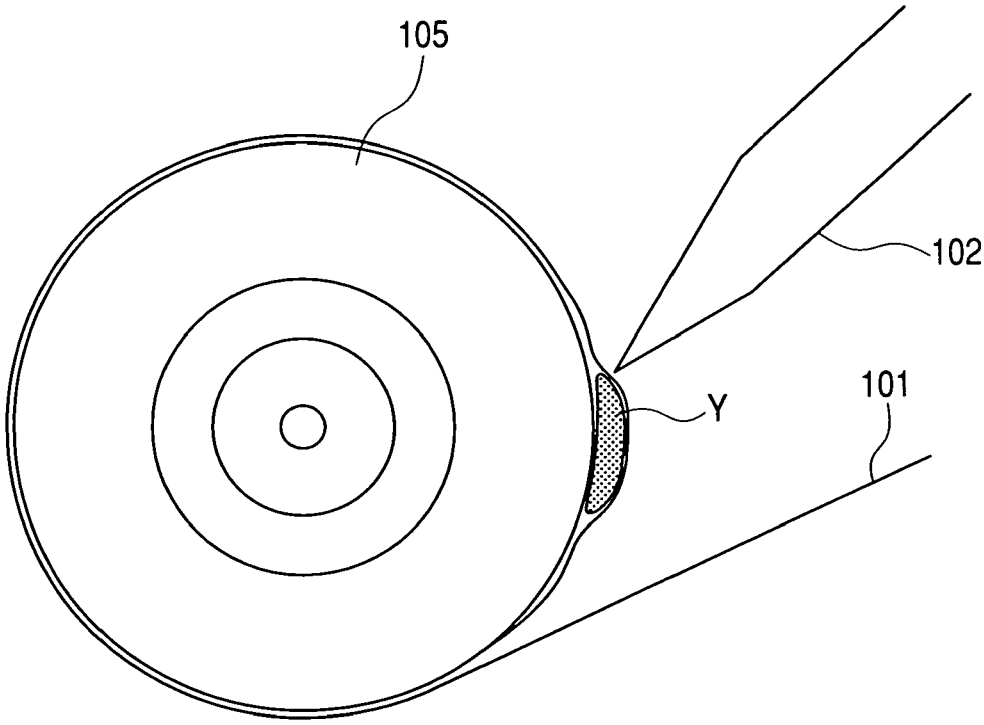
FIG. 5 is a schematic view showing a state that dust are stacked on the wheel portion.

On the other hand, the bill releasing and stopping position Lo is irrelevant to the number of released bills and is always held at the same position. As shown in FIG. 4, the dust on the periphery of the tape 101*a* which is wound around the wheel 105 is scraped by the scraper 102 as indicated by X. Then, the dust falls and is liable to be easily stacked like Y on the tape 101*b* which is unwound from the wheel 105. The dust Y which remains on the tape 101 is present as stepped portions formed on a surface of the tape which is wound around the wheel 5 at the time of winding or unwinding the tape as shown in FIG. 5 and brought into contact with the scraper 102 whereby the tape 101 is liable to be damaged locally.

Figure 6:
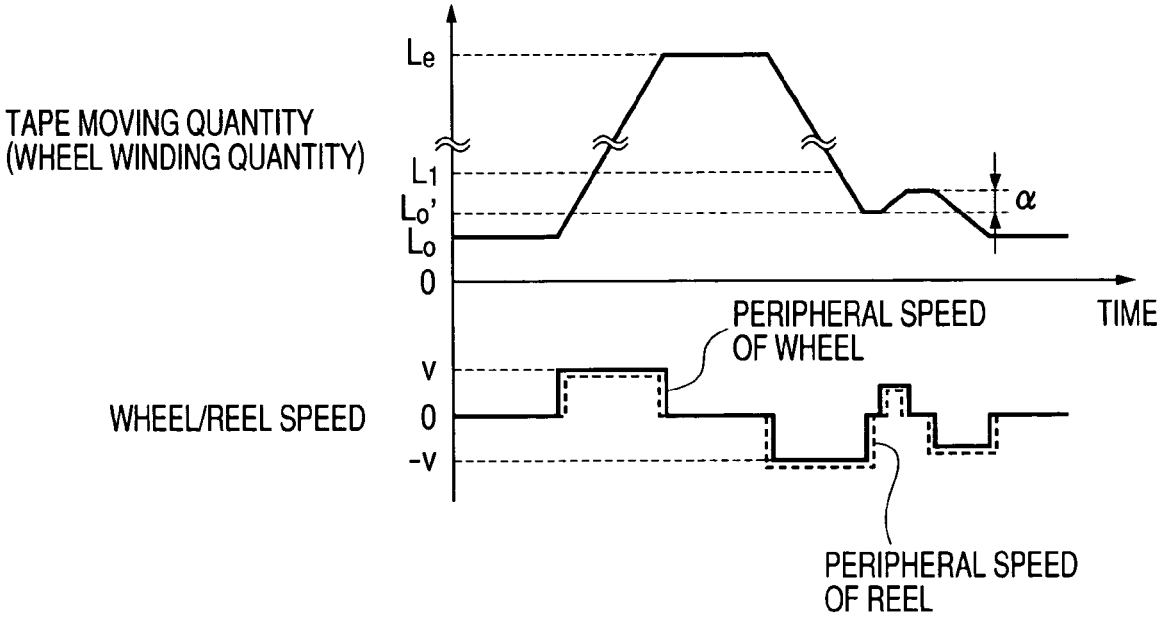
FIG. 6 is a view explaining the relationship between speeds of a wheel and a reel and a tape moving quantity in one embodiment of the present invention.

The present invention is provided for reducing the damage on the tape 101. One embodiment is explained in conjunction with FIG. 6 and FIG. 7 hereinafter. FIG. 6 is a schematic view showing a moving quantity of the tape and the speed relationship between the wheel and the reel in the same manner as FIG. 3. First of all, after releasing all the bills, during a period between the position L1 and the position Lo at which the releasing of the bills arrives, a position Lo' is provided and the releasing of the bills is temporarily stopped at the position Lo'. Here, the tape 101 is reversed by a given quantity $\alpha$. A reverse quantity $\alpha$ is set to an amount sufficient to transfer the scraped dust scraped by the scraper to the tape 101*b*. Thereafter, the bills are released to the final stop position Lo. Here, the dust Y which remains on the tape 101*b* is pulled out between the idler rollers 103 together with the tape and made to fall due to the gravity. Accordingly, a quantity of dust which is stacked at the final tape stop position Lo is reduced.

Figure 7:
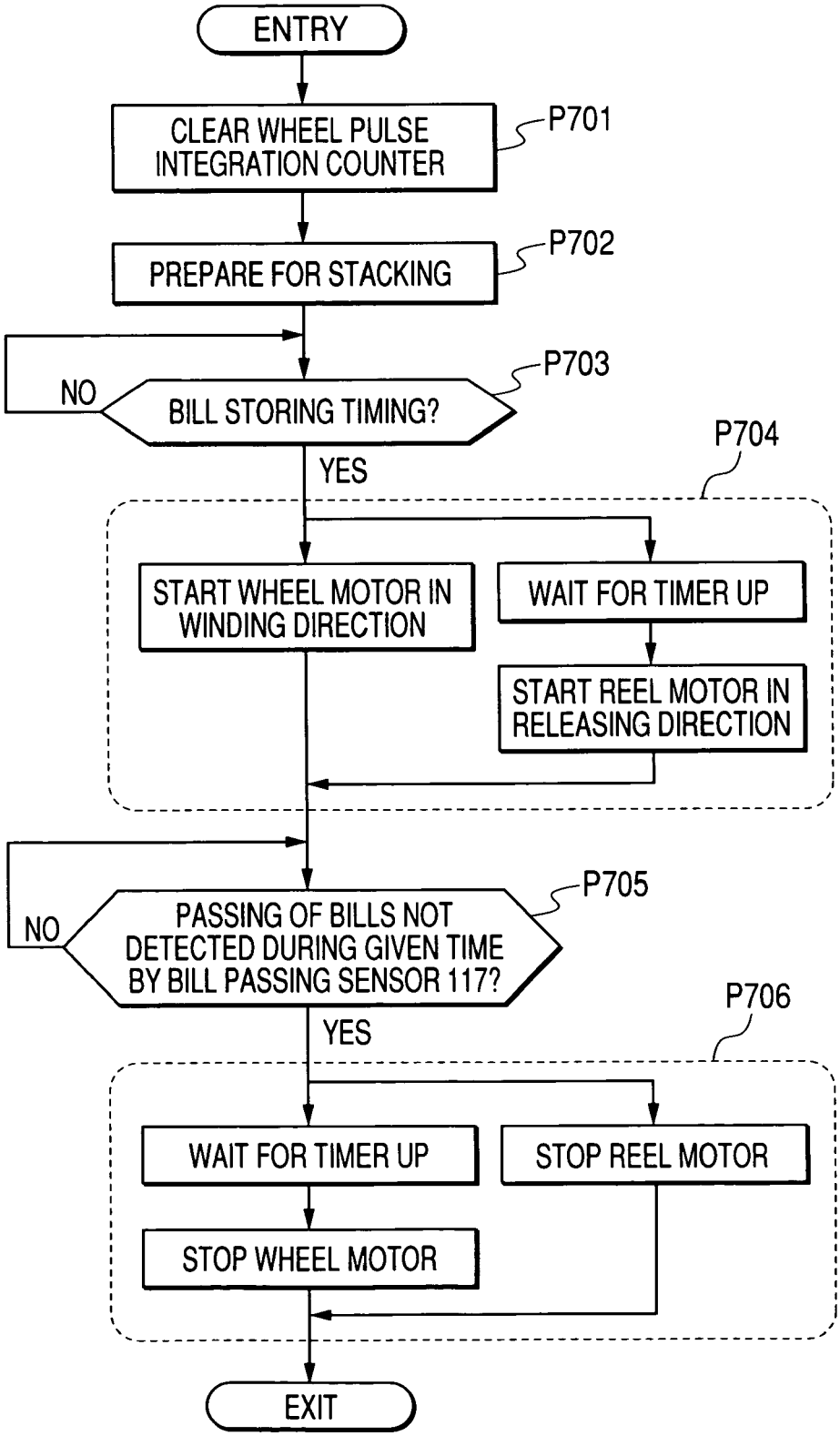
FIG. 7 is a flowchart showing a control operation of a wheel and a reel at the time of storing bills in one embodiment of the present invention.
Figure 8:
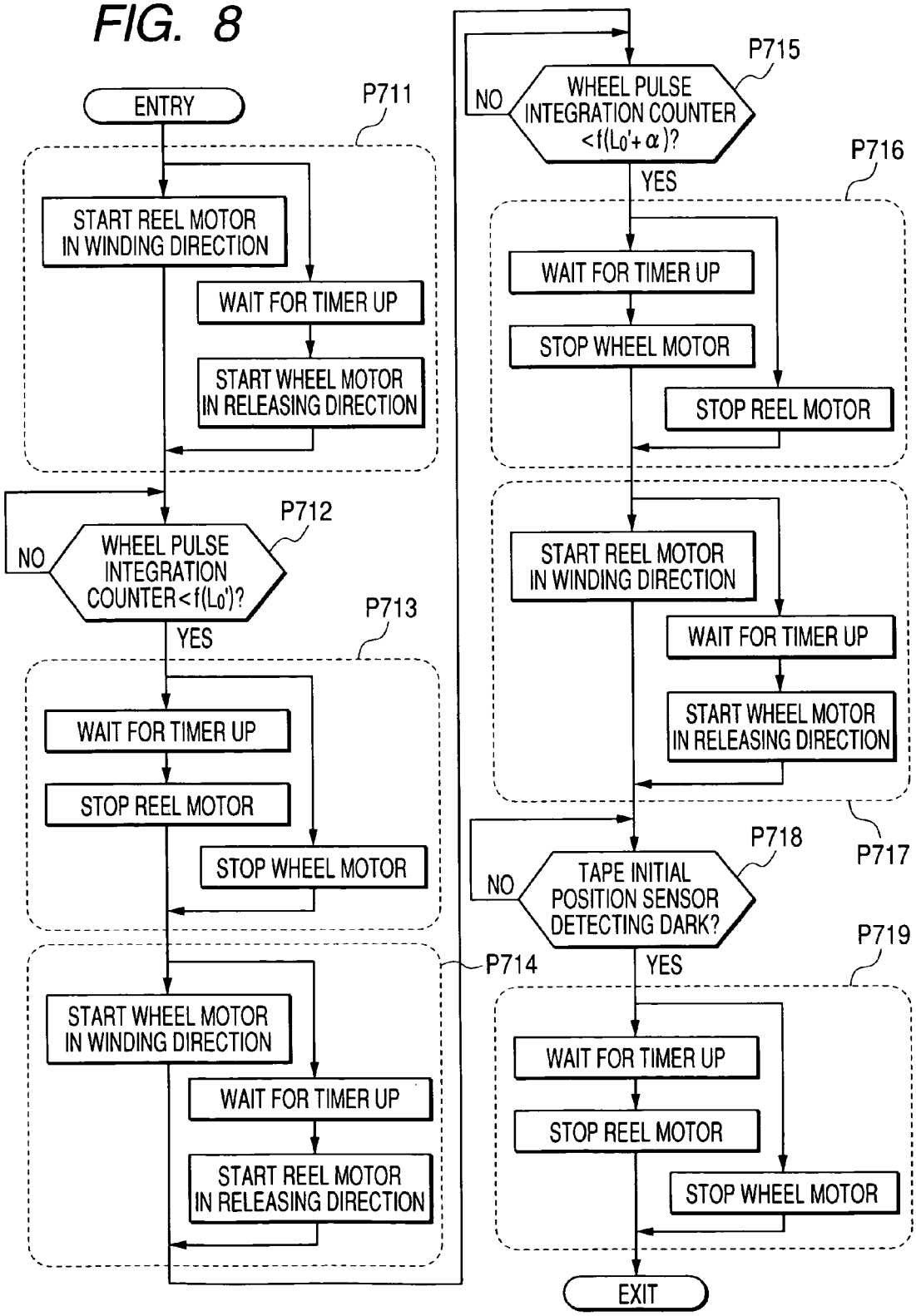
FIG. 8 is a flowchart showing a control operation of a wheel and a reel at the time of releasing bills in one embodiment of the present invention.

Next, the control operation for realizing the abovementioned manner of operation and advantageous effects are explained using a flowchart shown in FIG. 7 and FIG. 8.

First of all, the control at the time of storing bills is explained in conjunction with FIG. 7. Firstly, the wheel drive motor pulse integration counter is set to "0" (P701). This position is a position which corresponds to the position Lo and, assuming a function which converts the tape moving quantity L into a count value of the wheel drive motor pulse integration counter, f(Lo)=0 is established. Next, the preparation for stacking is performed (P702). Here, the tape 101 is temporarily stopped at Lo' and, thereafter, a quantity of the tape 101 which is sufficient to be pulled out to the position Lo from the wheel 105 is wound around the wheel 105 beforehand. Next, whether or not the bills can be transported to the paper sheet storing and releasing apparatus 40 is judged based on information of the discrimination part 30 (P703). When it is judged that the bills can be transported, first of all, the wheel drive motor is started in the tape winding direction and, subsequently, the reel drive motor is started in the tape releasing direction after a lapse of a given time (P704). By performing starting with a time delay or a time difference, it is possible to perform the control without slackening the tape. Further, at the time of stopping, the drive motor at the winding side is stopped last. In such a state, the bills are wound around and stored in the wheel 105. When all the stored bills are wound around the wheel 105 and the passing of the bills is not detected f or a given time by the bill passing sensor 117 (P705), it is judged that the bills are not transported and the respective motors are stopped (P706).

Next, the control at the time of releasing bills is explained in conjunction with FIG. 8. The reel drive motor is started in the winding direction and the wheel drive motor is started in the releasing direction after a lapse of a given time so as to start the releasing of the bills (P711). The respective motors are controlled until the count value of the wheel drive motor pulse integration counter becomes smaller than f(Lo') (P712). When the releasing of the tape to Lo' is detected based on the state that the count value of the wheel drive motor pulse integration counter becomes smaller than f(Lo'), the respective motors are stopped thus stopping the tape temporarily (P713). Then, the motors are started in the direction to wind around the wheel 105 in the reverse direction (P714) and are operated until the tape is moved by a (P715). When the state that the tape is moved by a is detected by the state that the count value of the wheel drive motor pulse integration counter becomes larger than f(Lo'+α), the respective motors are stopped (P716) and the motors are again driven to move the tape in the releasing direction (P717). When the tape initial position sensor detects the light blocking coated portion on the tape (P718), this implies that the tape arrives at the final initial position and hence, the respective motors are stopped and the control is finished (P719).

Here, in the abovementioned example, although the tape positions Lo', Lo'+α are detected using the wheel drive motor pulse counter, it is be possible that a detection pattern is formed on the tape per se and the tape position is detected based on the pattern detected by a tape initial position sensor.

Next, some other embodiments of the present invention are explained in conjunction with FIG. 9 to FIG. 12.

Figure 10:
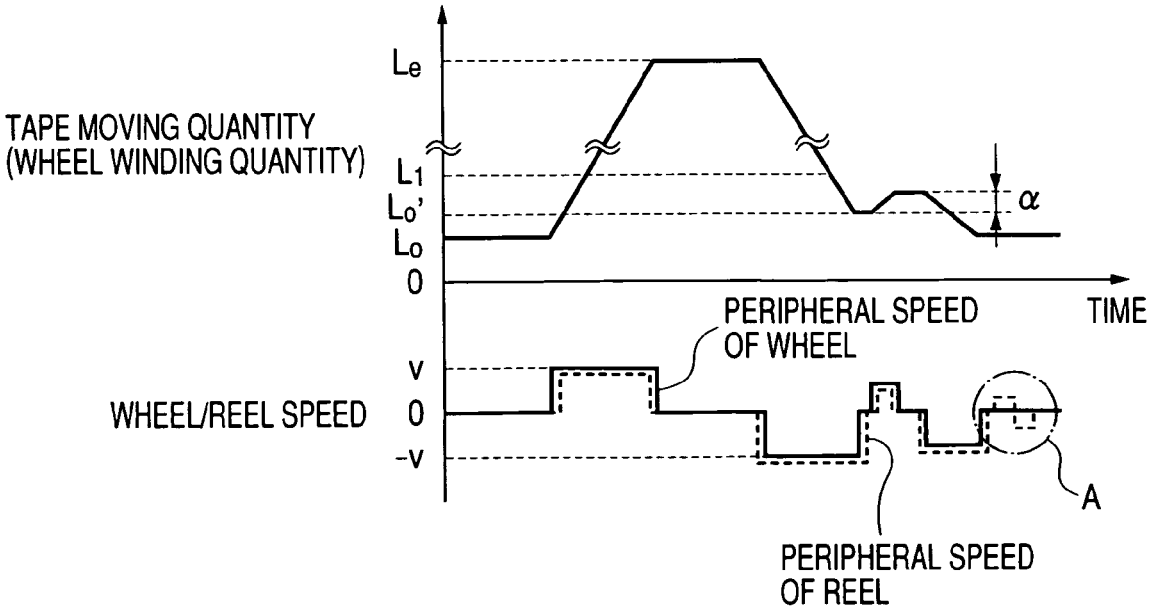
FIG. 10 is a view showing the relationship between speeds of a wheel and a reel and a tape moving quantity in another embodiment.
Figure 11:
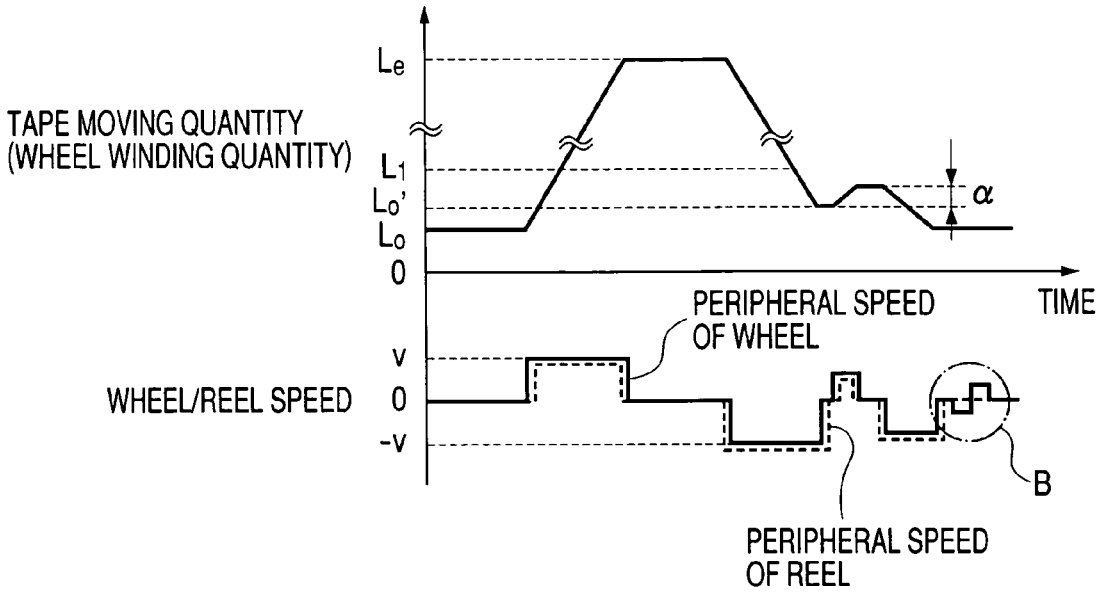
FIG. 11 is a view showing the relationship between speeds of a wheel and a reel and a tape moving quantity in still another embodiment.
Figure 12:
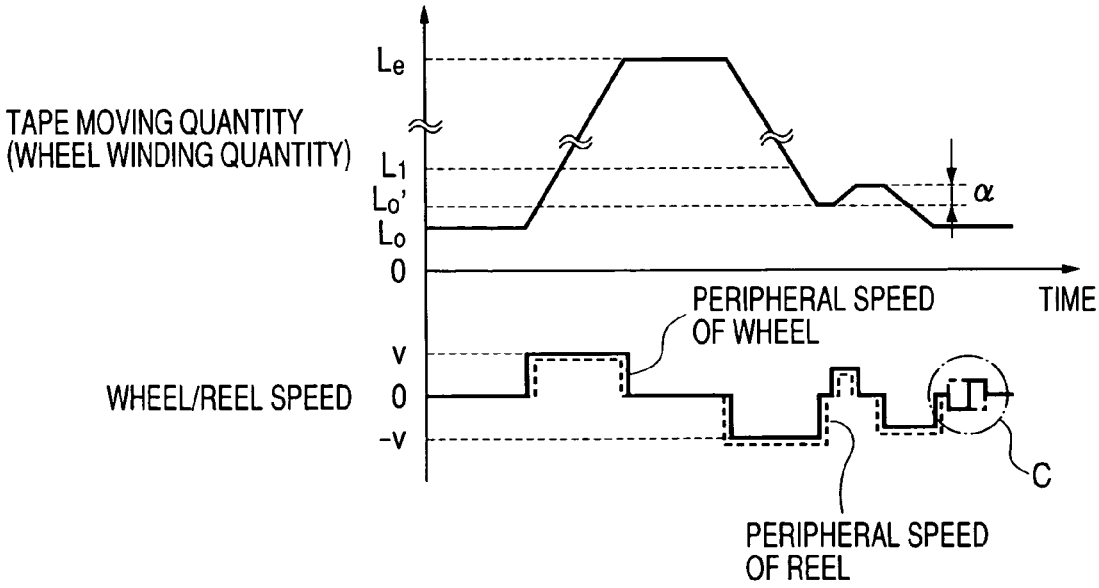
FIG. 12 is a view showing the relationship between speeds of a wheel and a reel and a tape moving quantity in still another embodiment.

In sequences shown in FIG. 10, FIG. 11 and FIG. 12, these embodiments are equal to the abovementioned embodiment shown in FIG. 6 with respect to the constitution that the tape 101 is temporarily stopped at the position Lo' and then the tape is released up to the position Lo. After pulling out the tape to the position Lo, the dust Y is present between the idler pulleys 103.

Figure 9:
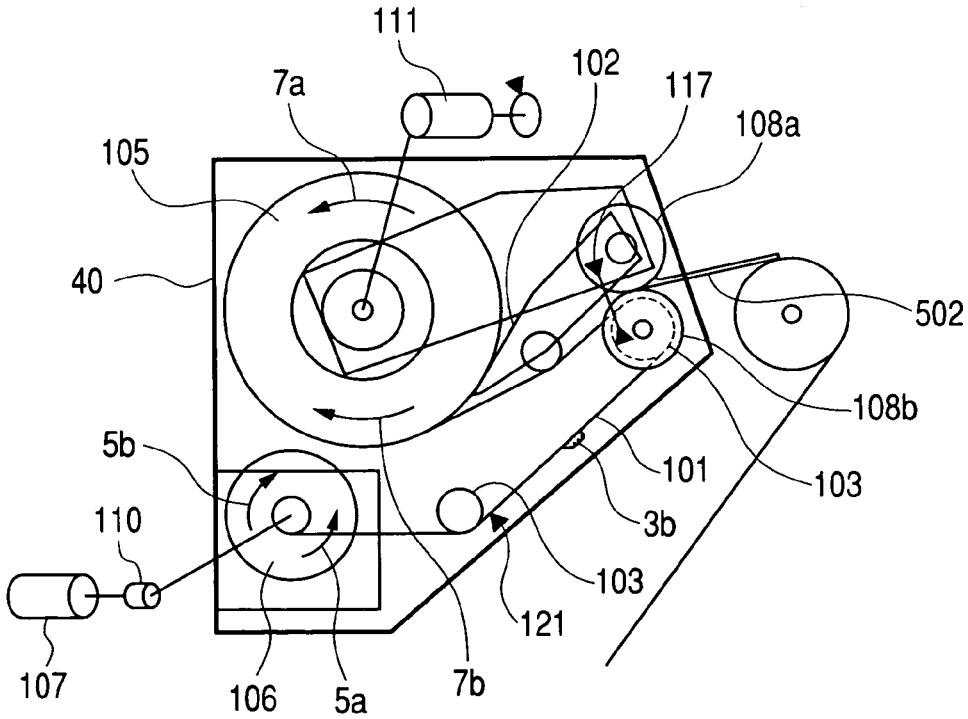
FIG. 9 is a schematic view showing a paper sheet storing and releasing device according to another embodiment of the present invention.

Here, in the second embodiment, as shown in FIG. 9 and a portion A in FIG. 10, the reel drive motor 107 is finely started in the tape releasing direction 5*a* so as to weaken a tension imparted to the tape 101. Subsequently, the dust Y which is adhered to the tape 101 is made to fall due to the vibrations of the tape 101 which are generated when the reel driving motor 107 is started in the tape winding direction 5*b* so as to impart the tension to the tape 101 again.

Further, in the third embodiment, as shown in a portion B in FIG. 11, the wheel drive motor 111 is finely started in the tape releasing direction 7*a* so as to weaken a tension imparted to the tape 101. Subsequently, the dust Y which is adhered to the tape 101 is made to fall due to the vibrations of the tape 101 which are generated when the wheel drive motor 111 is started in the tape winding direction 7*b* so as to impart the tension to the tape 101 again.

Further, in the fourth embodiment, as shown in a portion C in FIG. 12, the wheel drive motor 111 and the reel drive motor 107 are finely started in the tape releasing directions 7*a* and 5*a* so as to weaken a tension imparted to the tape 101. Subsequently, the dust Y which is adhered to the tape 101 is made to fall due to the vibrations of the tape 101 which are generated when the wheel drive motor 111 and the reel drive motor 107 are started in the tape winding directions 7*b* and 5*b* so as to impart the tension to the tape 101 again.

As described above, although the dust is made to fall only by the gravity in the first embodiment which is explained in conjunction with FIG. 6, according to the second to the fourth embodiments, the control is made to impart the vibrations to the tape and hence, it is possible to make the dust adhered to the tape fall more effectively and hence, the dust which remains on the tape can be further reduced.

With respect to the reverse rotation quantities of the wheel drive motor and the reel drive motor, so long as the tension of the tape is decreased, it is not necessary to feed the tape per se. To the contrary, when the reverse rotation quantities are increased, the slackening of the tape is increased and this easily leads to meandering of the tape. Further, at the time of imparting the tension to the tape again, by driving the wheel drive motor with the reverse rotation quantity larger than the reverse rotation quantity of reel drive motor, it is possible to set the proper tension using the torque limiter 110. In the third embodiment, the reel drive motor may be driven in the winding direction after stopping the wheel drive motor.

Here, although the vibrations are imparted to the tape once in the example shown in FIG. 10, FIG. 11 and FIG. 12, the control may be made to impart the vibrations to the tape plural times. In this case, although the treatment time may be prolonged, it is expected that a larger quantity of dust can be made to fall.

According to the present invention, in the paper sheet storing and releasing apparatus, it is possible to reduce stacking of the foreign material on the tape. Accordingly, the lifetime of the tape is prolonged and a defect occurrence ratio can be lowered.

What is claimed is:

1. A paper sheet storing and releasing apparatus comprising:

a reel which winds and unwinds a tape; and a wheel which winds and unwinds the tape and paper sheets in a state that paper sheets are sandwiched between the tape and the wheel, wherein at the time of unwinding the tape from the wheel, before the tape arrives at a stop position which constitutes a reference, the unwinding of the tape is temporarily stopped and the tape is moved in a direction to wind the tape on the wheel and is stopped, and an operation to unwind the tape from the wheel is performed again so as to stop the tape at the stop position which constitutes the reference.

2. The paper sheet storing and releasing apparatus according to claim 1, wherein after stopping the tape, the reel is driven in the tape unwinding direction and the tape winding direction by a given quantity.

3. The paper sheet storing and releasing apparatus according to claim 1, wherein after stopping the tape, the wheel is driven in a tape unwinding direction and the tape winding direction by a given quantity.

4. The paper sheet storing and releasing apparatus according to claim 1, wherein after stopping the tape, the wheel and the reel are driven in the tape unwinding direction and the tape winding direction by a given quantity.

5. An automatic teller machine having the paper sheet storing and releasing apparatus described in claim 1.

6. An automatic teller machine having the paper sheet storing and releasing apparatus described in claim 2.

7. An automatic teller machine having the paper sheet storing and releasing apparatus described in claim 3.

8. An automatic teller machine having the paper sheet storing and releasing apparatus described in claim 4.

9. A tape control method in a paper sheet storing and releasing apparatus which includes a reel which winds and unwinds a tape and a wheel which winds and unwinds the tape and paper sheets in a state that paper sheets are sandwiched between the tape and the wheel, the tape control method comprising:

a first winding step which winds the tape around the wheel in a state that the fed paper sheets are sandwiched between the tape and the wheel by rotating the wheel and the reel in a normal direction;

a tape releasing step which sequentially releases the paper sheets which are sandwiched between the wheel and the tape while releasing the tape by rotating the wheel and the reel in a reverse direction;

a stop step which temporarily stops the tape after releasing the paper sheets during the tape releasing step;

a second winding step which winds the tape around the wheel by a given quantity by moving the tape in the normal direction after the stop step; and a winding step which winds the tape around the reel up to a stop position which constitutes a reference after the second winding step.

10. The tape control method according to claim 9, wherein the paper sheet storing and releasing apparatus includes an idler roller which guides running of the tape between the reel and the wheel, and performs the stop step and the second winding step to make fall dust stacked on a portion of the tape which has already released the paper sheets and almost reaches the idler roller.

11. The tape control method according to claim 9, wherein the stop step and the second winding step are performed alternately plural times.

12. The tape control method according to claim 10, wherein the stop step and the second winding step are performed alternately plural times.

13. A paper sheet storing and releasing apparatus which stores and releases paper sheets comprising:

a reel which winds and unwinds a tape;

a wheel which winds and unwinds the tape and paper sheets in a state that paper sheets are sandwiched between the tape and the wheel; and a control mechanism which, during a period that the paper sheets which are sandwiched between the wheel and the tape are sequentially released by releasing the tape by rotating the wheel and the reel in a reverse direction, generates vibrations on the tape after releasing the paper sheets.

14. The paper sheet storing and releasing apparatus according to claim 13, wherein the vibration control mechanism preferably generates the vibrations on the tape by moving the tape to a position where a position of a surface of the tape wound around the reel is directed downwardly and by moving the reel or the wheel at the position in the tape winding direction by a given quantity thus changing a tension imparted to the tape.

* * * * *